United States Patent [19]

Pruitt

[11] Patent Number: 4,774,775

[45] Date of Patent: Oct. 4, 1988

[54] SKI-BOOT WALKER ACCESSORY

[76] Inventor: Walter L. Pruitt, 5378 Smooth Meadow Way #22, Columbia, Md. 21044

[21] Appl. No.: 73,492

[22] Filed: Jul. 15, 1987

[51] Int. Cl.[4] ..... A43B 5/00; A43B 5/04; A43C 13/06

[52] U.S. Cl. ..... 36/132; 36/117

[58] Field of Search ..... 36/132, 117, 7.5, 136; 12/120.5

[56] References Cited

U.S. PATENT DOCUMENTS

| | | | |
|---|---|---|---|
| 1,938,617 | 12/1933 | Augusta . | |
| 2,278,626 | 4/1942 | Vasko . | |
| 2,423,354 | 7/1947 | Van Hoesen . | |
| 2,519,613 | 8/1950 | Urban . | |
| 2,525,205 | 10/1950 | Doerschler . | |
| 3,971,144 | 7/1976 | Brugger-Stuker | 36/117 X |
| 4,045,890 | 9/1977 | D'Alessandro et al. | 36/132 |

FOREIGN PATENT DOCUMENTS

| | | | |
|---|---|---|---|
| 2314847 | 10/1974 | Fed. Rep. of Germany | 36/132 |
| 2424875 | 12/1975 | Fed. Rep. of Germany | 36/132 |
| 2073260 | 10/1971 | France | 36/117 |

*Primary Examiner*—James Kee Chi

[57] ABSTRACT

A quick-attach/detach footwear-sole rocker system provides for wearers of inflexible-sole footwear such as ski-boots to attach one to each boot sole and enjoy pivotal motion while walking. Each rocker has an elastic loop which may be of bungee cord extending forwardly and one extending rearwardly, for tightly looping around a boot toe portion and heel portion respectively. Adjustment may be by placing knots in the bungee cord at desired locations fixing the cord relative to hole structure in the rocker. Use-ready transport and storage of the rocker system when not in use is provided: a hook on one loop provides for stretching the rocker system around a boot-top or ankle portion and attaching the loops together.

1 Claim, 1 Drawing Sheet

SKI-BOOT WALKER ACCESSORY

FIELD OF THE INVENTION

This invention relates generally to footwear and specifically to an improved system for making walking easier with boots of the type having substantially inflexible soles.

BACKGROUND OF THE INVENTION

Modern conventional ski-boots offer an example of footwear with relatively flat, non-bending soles. Other examples include foot covering made inflexible by plaster of Paris or otherwise braced for special medical or mechanical reasons, but this invention will be described in combination with ski-boots, the most common and widely used flat, rigidsole footwear.

Known in the art are the showings of the following U.S. Pat. Nos.:

1,938,617 to A. Augusta, Dec. 12, 1933, showed a strap-attachable member with heel and a sole that extends forward to the metatarsal area forming a pivotal support for walking without need to flex the shoe;

2,278,626 to J. R. Vasko, Apr. 7, 1942, showed a lace-up rounded bumper of rubber or the like that can be attached under a rigid cast on the foot to make it easier to walk;

2,423,354 to F. B. Van Hosen, July 1, 1947, showed a zipon boot with a "U"-shaped metal "walking iron" transversely supported under the instep;

2,519,613 to F. K. Urban, Aug. 22, 1950, showed a clampon device with a cylindrical lower surface transverse to the shoe making it easier and safer to walk with an injured foot;

2,526,205 to E. E. Doerschler, Oct. 17, 1950 (Re. U.S. Pat. No. 23,348) showed a rocker-shaped or arcuate ground-engaging surface attachable by wires to a cast; material suggested was rubber, plastic or wood pulp, for expendability.

Taken together these patents suggest that it is known to provide a system of flat topped detachable transversely extending member with length sloped to the front and rear forming a high central support for use under the rigid sole of a shoe or boot as a pivot for easier walking, and to make the member of resilient and/or disposable material.

SUMMARY OF THE INVENTION

However, such systems are not in widespread use, and a principal object of this invention is to provide a system as described that improves the general concept and makes such systems standard in the industry for the purposes noted.

Further objects are to provide a system as described with use-ready self-storing on boots when not in use and that offers two modes of use.

And further objects are to provide a system as described that teaches proper posture for skiing with knees slightly flexed, when the user stands with boot pivoted forward, boot toes touching the floor.

Still further objects are to provide such a system that has easy adjustment for locating walking pivot point as desired; fits a wide range of sizes of footwear, up to the largest made, that requires no modification of conventional modern ski-boots for use thereon, that is efficient, economical, easy to use, safe when used as intended, durable and reliable and attractive in appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1A:
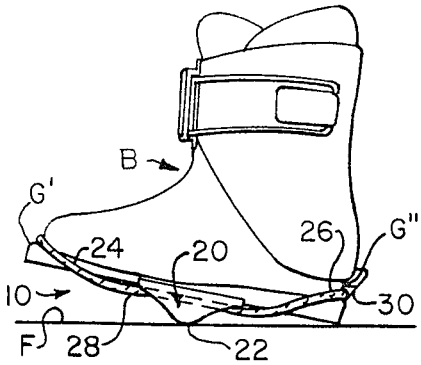
FIG. 1*a*, 1*b* and 1*c* show a ski-boot with the preferred embodiment of the invention attached, in progressive stages of walking.

FIG. 1*a* shows the invention in preferred embodiment 10, a pivotal support system, installed on a ski-boot B of any conventional modern type. The wearer (not shown) is beginning a stride with rocker 20 on the floor F or other surface. Only the rounded apex 22 part of the rocker 20 touches the ground.

The rocker 20 is attached to the boot by a pair of loops; first and second loops 24, 26 of elastic, preferably bungee cord 28 that extend from the rocker 20 around the front or toe end of the boot and the rear or heel end of the boot in the conventional binding clamping grooves G', G'' of the boot.

A hook 30 pivotally held on loop 26 at the heel end provides for storage of the system when removed from use on the sole of the boot as will be described.

Figure 1B:
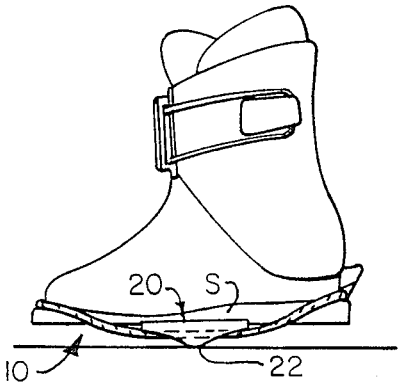

FIG. 1*b* shows at the midpoint of a stride the function of the rocker in providing a pivot at the apex 22 of the rocker more normal walking motions than the conventionally stiff or inflexible boot sole S would otherwise permit.

Figure 1C:
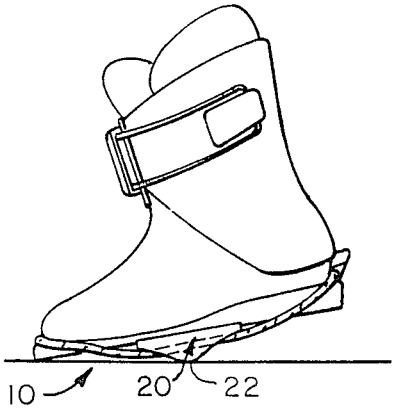

FIG. 1*c* shows the stride-ending position, with rocker 20 pivoted forward of the apex 22 and the substantially normal leg and foot angle relative to the floor completing the substitution for the usual noisy Frankenstein-like clomping.

Figure 2:
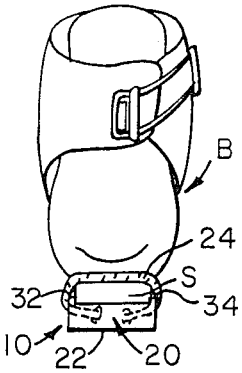
FIG. 2 is a front elevational view of the showing of FIG. 1*b;*

FIG. 2 shows in the front elevational view of the boot B with the system or embodiment 10 of the inventions attached, how the rocker 20 and apex 22 of it are preferably wider than the sole S of the boot and how the rocker preferably has flanges 32, 34 along the edges to hold the boot sole and restrain lateral movement relative to the boot sole. Except for the flanges the rocker is preferably uniform in height and in longitudinal cross-section. The bungee cord loop 24 extneds forwardly from holes in the rocker as will be indicated and similarly rearwardly for the rear loop. To provide additional lateral stability the bungee cord extends from the rocker in outwardly diverging directions, and is tightly stretched.

The shape of the boot protruding portions at toe and sole retains the bungee cords as well, as will be seen.

A problem with pivotal systems of the type is what to do with them when they are not in use. Carried in the hand, they can be laid aside, left behind or lost, and at least will be bulky to carry in pockets. What's needed is an almost foolproof storage.

Figure 3:
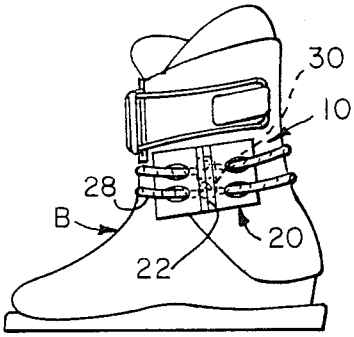
FIGS. 3 and 4 show respectively, elevational views of the left and right sides of a boot with the invention selfstored on the upper portion.

FIG. 3 shows the solution to the transport and storage problem. When not in use, the system 10 is looped around an upper portion or shank, or top or leg portion of the boot B and fastened to itself with the hook on the far side or inner side for least bothersome protrusion of the system during walking/skiing. The hook and the use-ready transport and storage that it provides show in later figures. Preferably the apex 22 of the rocker 20 is turned outward and the flat top of the rocker inward, also for least protrusion. The means for storing includes both the provision of hook and of the loop structures's extension around the boot upper a distance requiring no adjustment beyond being correct for attachment to the sole.

Figure 4:
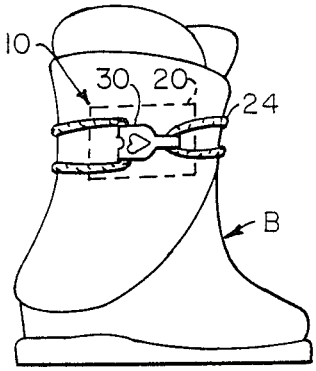

FIG. 4 shows the hoop 30 detachably engaging the forward loop 24 of the bungee 28. The rectangular plan view of the rocker shows, apex out. The hook 30 open side (or free-end) is preferably oriented to the inside, against the boot, so that it will not snag the opposite boot during walking/skiing. Convenience and memory-jogging of the storage wil be appreciated. Also, as noted above, the length of the bungee does not have to be adjusted; the stretched length suitable for looping engagement of the boot sole front and rear is about the same as the stretched length required to stretch around and hold on the shank of the boot, for storage.

Figure 5:
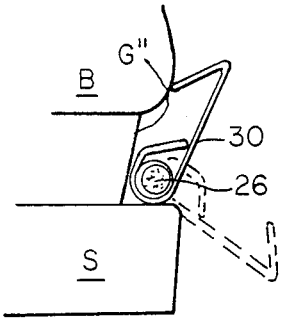
FIGS. 5 and 6 shows on an enlarged scale and in fragmentary, partly sectional elevational views, the relation in two positions of the boot when not in use storing the invention, as it may be used as a lever prying the bungee cord free of the recess around the heel of a boot.
Figure 6:
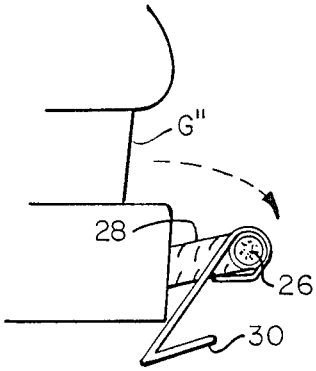

FIGS. 5 and 6 show successive positions of the hook 30; it has no function normally when the system is in use, during which it stores for safety at the rear of the sole S or a ski-boot in the clamping groove G". However, (FIG. 6, broken lines and arrow) the hook 30 can serve as a lever to pry the rear loop 26 of the bungee 28 free of the groove G" when removing the rocker from use-position under the boot sole.

Figure 7:
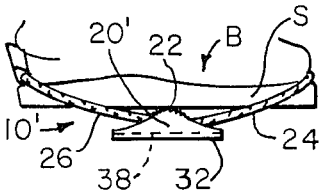
FIG. 7 shows in elevational view another mode of use of the system with an ordinary ski-boot; the embodiment may, but need not be, different; the special surfaces shown can apply to the rocker in any Figure.

FIG. 7 shows a further mode of use of the system, in a similar embodiment 10' with no modification required to it or to the boot. Permitting this is the generally longitudinal extension of the loops from the faces respectively of the inclined faces of the wedge shape.

In this mode the system is inverted, the flat face 38 of the rocker 20' is down and the apex 22 is up, supporting the boot B. (Loops 24, 26 are installed as usual). This places the pivot axis closer to the user's foot. Further, it leaves a greater-area 'footprint', possibly advantageous in some uncertain footing such as mud, and since it provides for the ground-contacting portion of the rocker 20' to be stationary rather than in rotary, moving contact with the ground, may offer non-slip advantages on ice or other slippery footing. Moving contact between shoe-sole S and apex 22 may help prevent accumulation of debris. Provision of non-slip surfaces as by rubber covering and/or serrating, indicated at 40, is possible, and the flanged edges, 32 shown, may help guide somewhat like blades of an ice skate.

Figure 8:
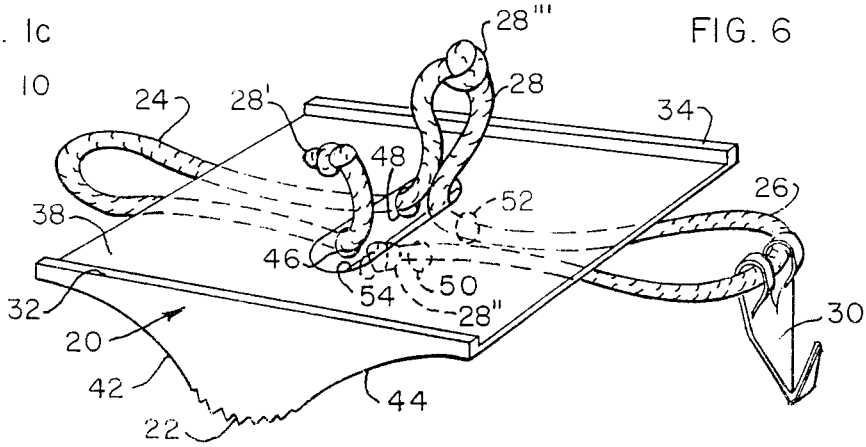
FIG. 8 shows in perspective view and on an enlarged scale, details and relations of the parts of the preferred embodiment.

FIG. 8 shows in embodiment 10 the apex 22, the preferably concave (non-slip) inclined surface 42, 44 between apex and upper, flat portion 38, the flanges 32, 34 and the bungee securance in two sets of paired fore and aft generally horizontal holes 46, 48, 50, 52 that lead through the inclined faces or surfaces 42, 44 into a transverse, upwardly open recess 54 centrally in the upper flat portion.

To adjust the longitudinal position of the rocker relative to a boot sole, or the tightness, it is only necessary to adjust the length of either loop or both loops 24, 26 by putting the knots 28', 28" in the free ends of the bungee cord 28, at positions desired. Third knot 28''' prevents slippage. The bungee cord 28 may be in one piece as shown, with knot 28''' in the bight on one side, that centers the cord but can be shifted to suit.

The hook 30 may be any suitable conventional hook of sheet metal or otherwise thin, lightweight material. It will be appreciated that use of bungee cord provides a safer, less abrasive and lighter system than a heavy metal spring would, and that the hook may be of plastic or plastic-coated, accordingly.

The rocker may be of wood or plastic or other suitable material, disposable and cheap, as will be evident from the above.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A rocker (20) for imparting pivotal walking motion to inflexible, substantially flat-sole footwear on detachable attachment of said rocker thereto, said detachable attachment including a first loop (24) extending forwardly from said rocker (20) and proportioned for looping around a toe portion of said footwear and a second loop (26) extending rearwardly from said rocker and proportioned for looping around a heel portion of said footwear, said loops (24, 26) being of elastic cord, said rocker (20) being wedge-shaped with an apex (22), the wedge-shape including a base portion (38) that is substantially flat and having first and second faces (42,44) between the apex(22) and the base portion (38) and said base portion (38) having spaced flanges (32,34) therealong for laterally locating a sole of said footwear therebetween, said detachable attachment further including said rocker (20) defining aperture structure (46, 48, 50, 52) in said rocker(20) and means for adjusting the respective sizes of said loops (24,26) and for adjustably preventing slippage of said loops (24,26) relative to the aperture structure (46,48,50,52), comprising: each said loop (24,26) having a respective free end adjustable in length by a respective knot (28',28") securing each said loop at said aperture structure, and means for adjustably preventing slippage of said loops (24,26) relative to the rocker (20), comprising a third knot (28''') being in the bight of the elastic cord between the first and second knots (28',28") and engaging said aperture structure (48,52) adjustably relative to said loops (24,26).

* * * * *